US009932827B2

(12) United States Patent
Skinner, Jr.

(10) Patent No.: US 9,932,827 B2
(45) Date of Patent: Apr. 3, 2018

(54) HYDRAULIC RADIAL PISTON DEVICES

(71) Applicant: EATON CORPORATION, Cleveland, OH (US)

(72) Inventor: Jeffrey D. Skinner, Jr., Madison, MS (US)

(73) Assignee: EATON INTELLIGENT POWER LIMITED, Dublin (IE)

( * ) Notice: Subject to any disclaimer, the term of this patent is extended or adjusted under 35 U.S.C. 154(b) by 314 days.

(21) Appl. No.: 14/592,981

(22) Filed: Jan. 9, 2015

(65) Prior Publication Data

US 2015/0114216 A1 Apr. 30, 2015

Related U.S. Application Data

(63) Continuation of application No. PCT/US2013/050104, filed on Jul. 11, 2013.

(60) Provisional application No. 61/670,397, filed on Jul. 11, 2012.

(51) Int. Cl.

| | |
|---|---|
| ***F01B 1/06*** | (2006.01) |
| ***F04B 1/107*** | (2006.01) |
| ***F01B 13/06*** | (2006.01) |

(52) U.S. Cl.

CPC ..... *F01B 1/0631* (2013.01); *F01B 13/065* (2013.01); *F04B 1/107* (2013.01)

(58) Field of Classification Search

CPC .. F01B 13/06; F01B 1/04; F01B 27/04; F01B 1/107; F01B 13/065

USPC ..... 92/72

See application file for complete search history.

(56) References Cited

U.S. PATENT DOCUMENTS

| | | | | |
|---|---|---|---|---|
| 1,696,139 A | | 12/1928 | Ferris | |
| 1,862,220 A | | 6/1932 | Johnson | |
| 2,074,068 A | | 3/1937 | Ferris | |
| 2,105,454 A | | 6/1938 | Ferris | |
| 2,262,593 A | * | 11/1941 | Stanley | F04B 1/0413 91/492 |
| 2,273,468 A | | 2/1942 | Ferris | |

(Continued)

FOREIGN PATENT DOCUMENTS

| | | |
|---|---|---|
| CH | 487 333 A | 3/1970 |
| DE | 822 770 C | 11/1951 |
| DE | 22 40 113 A1 | 2/1973 |

OTHER PUBLICATIONS

International Search Report for corresponding International Patent Application No. PCT/EP2013/050104 dated Jul. 11, 2013.

*Primary Examiner* — Michael Leslie
*Assistant Examiner* — Daniel Collins

(57) ABSTRACT

A radial piston device includes a housing and a pintle fixed thereto that includes an inlet and an outlet, each aligned with a pintle axis. A rotor is rotatably disposed around the pintle and includes radially oriented cylinders. A piston is axially displaceable in each cylinder and includes a head defining a spherical contact surface. A thrust ring is rotatably disposed within the housing about the rotor and is in contact with each piston, such that a rotation of the rotor rotates the thrust ring. An inner surface of the thrust ring defines a toroidal contact surface. A contact location between the spherical contact surface and the toroidal contact surface varies as the rotor rotates about the pintle. A drive shaft is engaged with the rotor, such that a rotation of the rotor rotates the drive shaft.

13 Claims, 15 Drawing Sheets

(56) References Cited

U.S. PATENT DOCUMENTS

| | | | | |
|---|---|---|---|---|
| 2,608,934 | A * | 9/1952 | Ferris | F01B 1/0648 417/272 |
| 3,066,613 | A | 12/1962 | Reinke | |
| 3,187,681 | A | 6/1965 | Firth et al. | |
| 3,564,976 | A | 2/1971 | Allen | |
| 3,695,147 | A | 10/1972 | Siesennop et al. | |
| 3,708,215 | A * | 1/1973 | Wilcock | F16C 17/20 384/102 |
| 3,857,326 | A | 12/1974 | Blandford | |
| 3,961,562 | A | 6/1976 | Kersten et al. | |
| 3,969,986 | A | 7/1976 | Ohrberg | |
| 4,635,535 | A | 1/1987 | Thoma et al. | |
| 4,686,829 | A | 8/1987 | Thoma et al. | |
| 4,920,859 | A | 5/1990 | Smart et al. | |
| 5,848,565 | A | 12/1998 | Thoma | |
| 6,464,590 | B2 | 10/2002 | Leutner et al. | |

* cited by examiner

HYDRAULIC RADIAL PISTON DEVICES

This application is a Continuation Application of PCT/US2013/050104 filed on 11 Jul. 2013, which claims benefit of U.S. Patent Application Ser. No. 61/670,397 filed on 11 Jul. 2012, and which applications are incorporated herein by reference. To the extent appropriate, a claim of priority is made to each of the above disclosed applications.

INTRODUCTION

Radial piston devices (either pumps or motors) are often used in aerospace hydraulic applications, and are characterized by a rotor rotatably engaged with a fixed pintle. The rotor supports a number of pistons in radial cylinders. When the device is in a motor configuration, hydraulic fluid is delivered into the pintle and forced outward into the cylinders. The force of the fluid against a piston located in each cylinder forces rotation of the rotor (as well as an associated drive shaft). A head of each piston contacts an outer thrust ring that is also rotatable relative to the pintle. Pressure applied by the contact between the heads and the thrust ring compels rotation of the thrust ring. Since the rotor is not axially aligned with the thrust ring, changes in the distance between the rotor axis and the trust ring axis have a direct effect on the power generated by the device.

SUMMARY

In one aspect, the technology relates to a radial piston device including: (a) a housing defining a housing hydraulic fluid inlet; (b) a pintle received within the housing and fixed relative to the housing, wherein the pintle includes: a pintle axis; a pintle wall defining a pintle inlet port and a pintle outlet port; a pintle hydraulic fluid inlet in fluidic communication with the housing hydraulic fluid inlet and aligned with the pintle axis and in fluidic communication with the pintle inlet port; and a pintle hydraulic fluid outlet aligned with the pintle axis and in fluidic communication with the pintle outlet port; (c) a rotor rotatably disposed around the pintle, wherein the rotor defines: a bore, wherein the bore is configured to be rotatably received around the pintle; a plurality of radially oriented cylinders including a first cylinder set including a first cylinder and a second cylinder adjacent to the first cylinder and aligned relative to an axis of the rotor; a first rotor fluid port in fluidic communication with the first cylinder set, wherein when the rotor is in a first position, the first rotor fluid port is in fluidic communication with the pintle inlet port, and wherein when the rotor is in a second position approximately 180 degrees from the first position, the first rotor fluid port is in fluidic communication with the pintle outlet port; (d) a first piston axially displaceable in the first cylinder and a second piston axially displaceable within the second cylinder, and wherein each of the first piston and the second piston includes a head defining a spherical contact surface; (e) a thrust ring rotatably disposed within the housing and about the rotor, wherein the thrust ring is in contact with each of the first piston and the second piston, such that a rotation of the rotor rotates the thrust ring, and wherein an inner surface of the thrust ring defines a toroidal contact surface, and wherein a contact location between the spherical contact surface of the first piston and the toroidal contact surface varies on the spherical contact surface as the rotor rotates from the first position to the second position; and (f) a drive shaft engaged with the rotor, such that a rotation of the rotor rotates the drive shaft.

In an embodiment of the above aspect, the draft shaft includes a plurality of blades oriented such during a rotation of the drive shaft, the plurality of blades force a hydraulic fluid into the pintle hydraulic fluid inlet. In another embodiment, the first piston includes a first piston axis extending radially from the pintle axis, and wherein the first piston is rotatable about the first piston axis during axial displacement. In yet another embodiment, the spherical contact surface of the first piston includes a radius of about 0.5". In still another embodiment, the toroidal contact surface of the thrust ring includes a radius of about 0.55".

In an embodiment of the above aspect, the toroidal contact surface of the thrust ring includes a radius of about 0.55". In another embodiment, the toroidal contact surface of the thrust ring includes a radius approximately 0.5" larger than the spherical contact surface of the first piston. In yet another embodiment, the toroidal contact surface includes a first toroidal contact surface and a second toroidal contact surface, and wherein the first toroidal contact surface contacts the first piston head, and wherein the second toroidal contact surface contacts the second piston head. In still another embodiment, the plurality of radially oriented cylinders further includes a second cylinder set adjacent to the first cylinder set, and wherein the second cylinder set includes a third cylinder and a fourth cylinder adjacent to the third cylinder and aligned relative to the axis of the rotor, and wherein the third cylinder and the fourth cylinder are axially offset along the rotor axis relative to the first cylinder and the second cylinder.

In another embodiment of the above aspect, the plurality of radially oriented cylinders further includes an opposing cylinder set radially disposed opposite the rotor axis from the first cylinder set. In yet another embodiment, the device includes a flexible coupling for engaging the drive shaft with the rotor. In still another embodiment, the flexible coupling defines an inlet in fluidic communication with the housing hydraulic fluid inlet and the pintle hydraulic fluid inlet.

BRIEF DESCRIPTION OF THE DRAWINGS

There are shown in the drawings, embodiments which are presently preferred, it being understood, however, that the technology is not limited to the precise arrangements and instrumentalities shown.

DETAILED DESCRIPTION

Reference will now be made in detail to the exemplary aspects of the present disclosure that are illustrated in the accompanying drawings. Wherever possible, the same reference numbers will be used throughout the drawings to refer to the same or like structure. In the present application, radial piston devices are described generally. These devices may be used in both motor and pump applications, as required. Certain differences between motor and pump applications are described herein when appropriate, but additional differences and similarities would also be apparent to a person of skill in the art. The radial piston device disclosed herein exhibits high power density, is capable of high speed operation, and has high efficiency. Additionally, the radial piston device may be manufactured without the use of specialized processes (brazing, swaging, etc.). Also, the devices described include no long lead-time rolling elements, such as bearings, and thus may have lower manufacturing costs than currently available radial piston devices. In one example, such a device can operate at pressures of 3,000 psi and rotating speeds of 12,000 rpm while maintaining a useful life in excess of 20,000 operating hours without replacement of the pistons and thrust ring. The technology herein is described in the context of radial piston devices, but the benefits of the technologies described may also be applicable to any device in which the pistons are oriented between an axial position and a radial position.

Figure 1A:
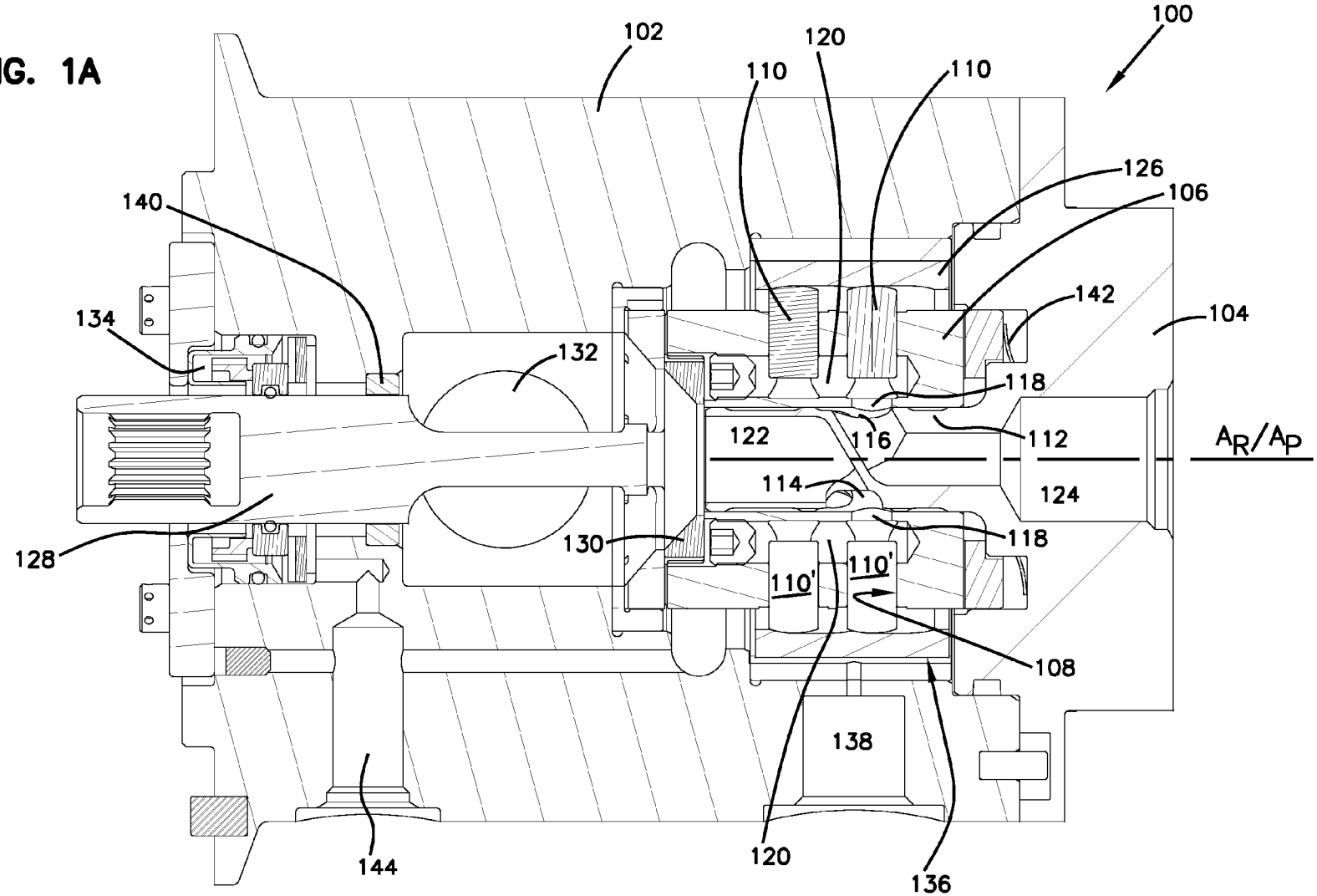
FIGS. 1A-1B are side sectional views of a radial piston device with a rotor in a first position and a second position, respectively.
Figure 1B:
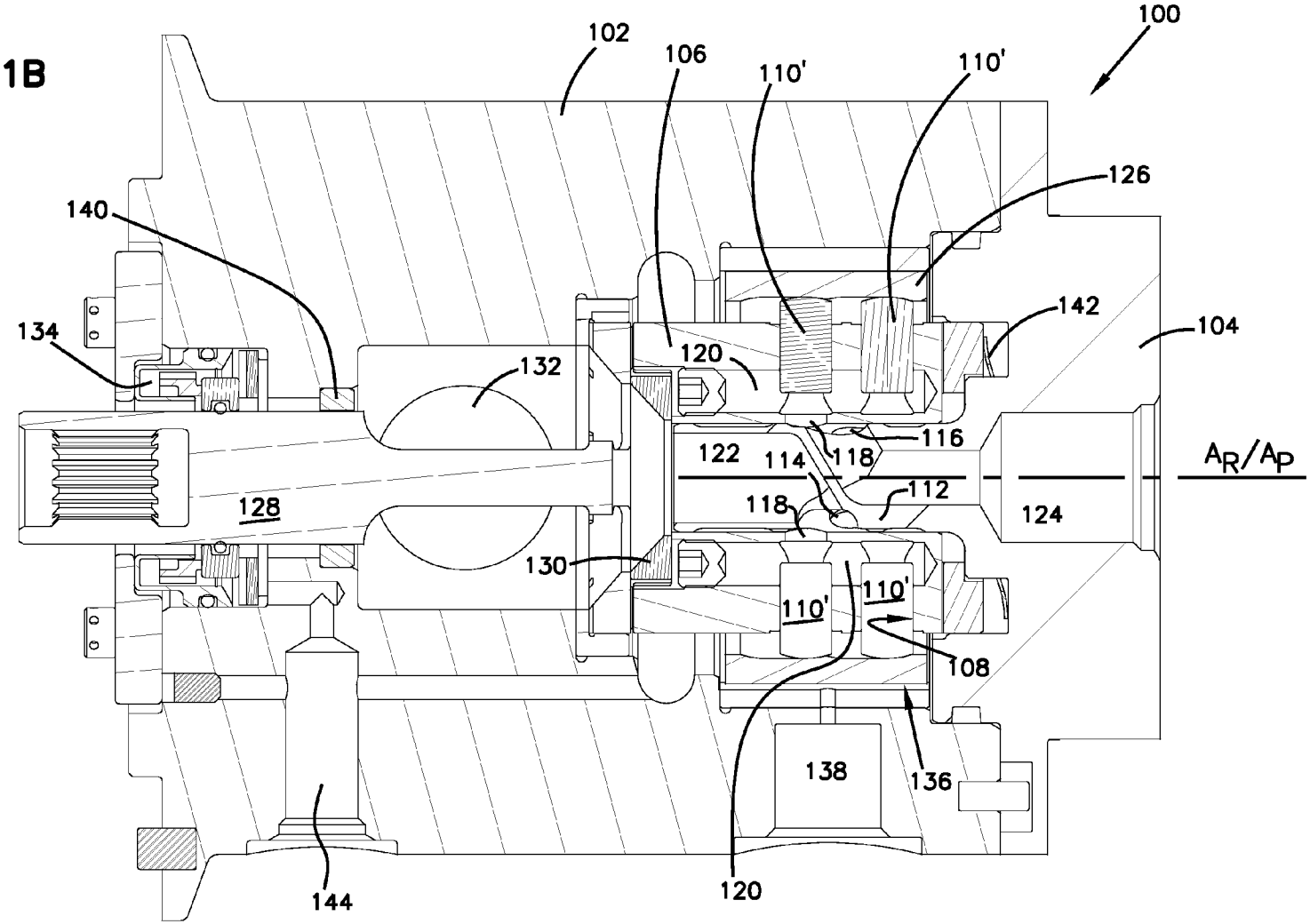

FIGS. 1A-1B are side sectional views of a radial piston device 100. The radial piston device 100 includes a housing connected at a first end to a pintle 104. A rotor 106 defines a bore that allows for rotatable mounting of the rotor 106 about the pintle 104. The rotor 106 defines a number of radial cylinders 108 that each receive a piston 110. In the depicted embodiment, the cylinders 108 are in paired configurations such that two cylinders 108 are located adjacent each other along a linear axis parallel to a rotor axis $A_R$. In the present application, such linearly-aligned cylinders 108 and pistons 110 are referred to as cylinder sets and piston sets, respectively. The rotor axis $A_R$ is coaxial with a pintle axis $A_P$. The pintle 104 includes a pintle wall 112 that defines a pintle inlet port 114 and a pintle outlet port 116 therethrough. Rotor fluid ports 118 penetrate an inner wall of the rotor 106 that defines the bore, and a common fluid inlet 120 for each cylinder set is in fluid communication therewith. The rotor fluid ports 118 allow for fluidic communication between both of the pintle inlet port 114 and the pintle outlet port 116 (based on the position of the rotor 106) and the common fluid inlet 120. When the radial piston device 100 is in a pump application, the hydraulic flow through the inlets and outlets is reversed.

The pintle 104 also defines a pintle hydraulic fluid inlet 122 and a pintle hydraulic fluid outlet 124. The pintle hydraulic fluid inlet 122 and the pintle hydraulic fluid outlet 124 are substantially aligned with the pintle axis $A_P$ and are in fluidic communication with the pintle inlet port 114 and the pintle outlet port 116, respectively. Each piston 110 is in contact with a cam ring or thrust ring 126, which is rotatably mounted in the housing 102. Various embodiments of the thrust ring 126 are described in further detail below. A drive shaft 128 is connected to the rotor 106 at a flexible coupling 130. A portion of the drive shaft 128 is located within the housing 102, such that hydraulic fluid entering the housing 102 via a housing hydraulic fluid inlet 132 flows around the drive shaft. An oil seal assembly 134 surrounds the drive shaft 128 and prevents hydraulic fluid from inadvertently exiting the housing 102. These and other components are described in more detail below.

The thrust ring 126 is supported radially with a hydrodynamic journal bearing 136. Temperature and/or pressure within the housing 102 may be monitored at a number of different locations, for example at a sensor port 138. In certain embodiments, such as low speed, high pressure devices, it may be desirable to supplement the hydrodynamic forces with a hydrostatic pad, thus forming a hybrid journal bearing. The rotor 106 is also supported radially on the pintle 104 with hydrodynamic journal bearings. The radial load on the rotor 106 may be balanced by setting the seal land lengths as required or desired for a particular application. Small journal bearing lengths also may be included on the pintle 104 at the axial extremities of the rotor bore, so as to support any oscillatory moment acting on the rotor 106 due to piston porting. The drive shaft 128 is supported with a plurality of alignment bushings 140 such that there is no radial load on the drive shaft 128.

The device 100 may utilize an axial thrust force generated from a thrust washer 142 to bias the power transfer assembly (FIGS. 3A-3B) toward the drive shaft end of the housing 102. This alleviates potential tolerance stack error between the rotor 106 and the thrust ring 126. Further, the flexibility of the thrust washer 142 prevents binding of the rotating power transfer assembly due to thermal growth, as well as supports the rotor 106 in the event of external vibration or shock loading as expected in aerospace applications. The device 100 may also include ports at both ends of the rotating power transfer assembly to allow forced fluid cooling of the device 100 for improved reliability. In alternate embodiments, the device 100 may include retainer devices to hold the pistons 110 against the thrust ring 126. This is particularly useful if the device is intended to operate at low speed (i.e., speeds below which the centrifugal forces on the pistons 110 and fluid are insufficient to maintain a compressive force between the pistons 110 and the inner surface of the thrust ring 126). A case drain 144 may connect to any number of interior chambers of the housing 102.

Figure 2A:
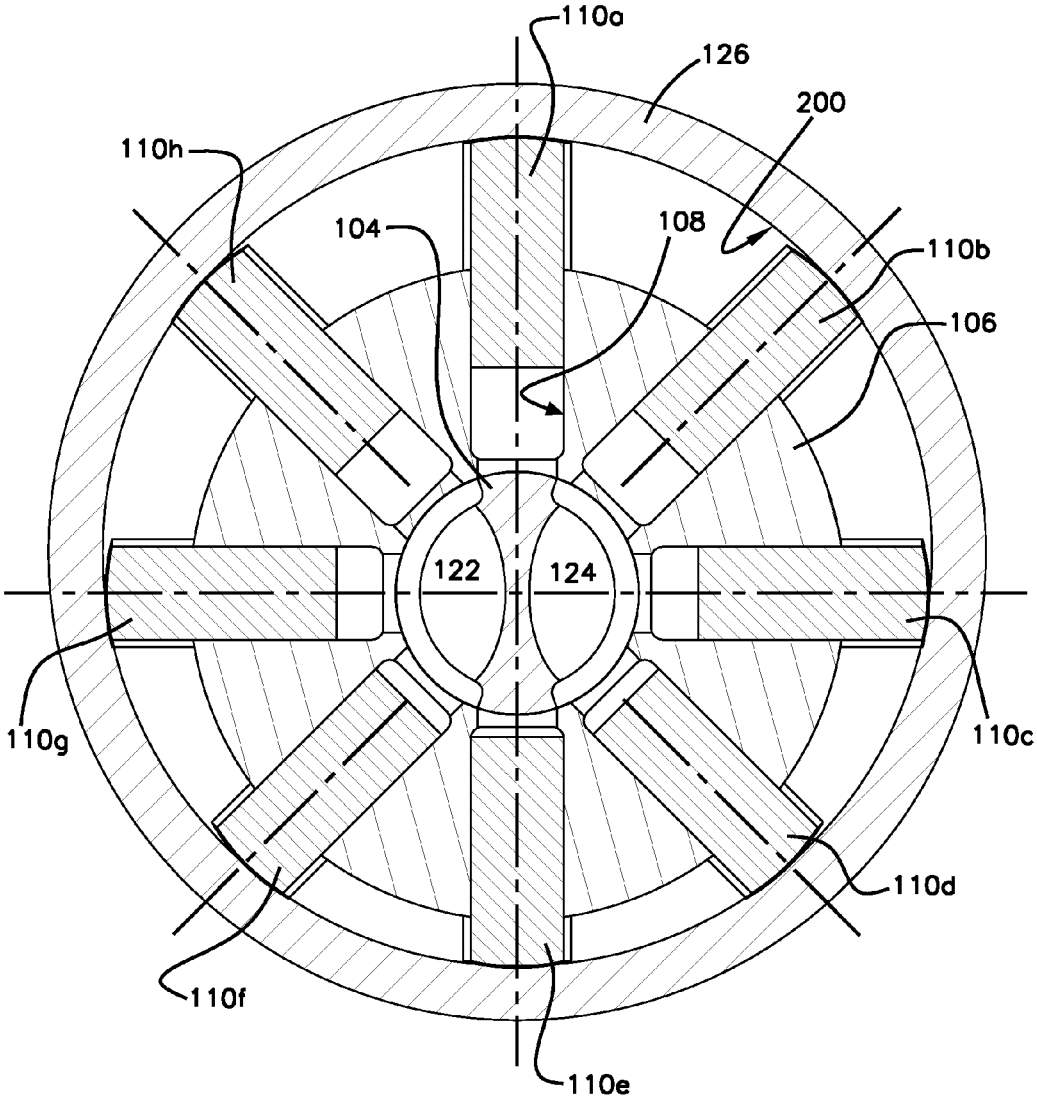
FIG. 2A is an end sectional view of the radial piston device of FIGS. 1A and 1B.

FIG. 1B depicts the radial piston device 100 of FIG. 1A, with the rotor 106 rotated 45 degrees. Most relevant to this view is the location of the pistons 110', relative to the thrust ring 126. The pair of pistons 110 are located adjacent the pistons 110 depicted in FIG. 1A (as depicted in FIG. 2A). The piston 110' rows are offset from the piston 110 rows of FIG. 1A. This configuration is described further below. In general, however, offsetting the rows of pistons around the rotor 106 allows the overall size of the rotor 106 (and therefore the device 100) to be reduced. Additionally, the offsetting of the piston rows balances the thrust loads on the rotor that are generated due to contact between the thrust ring 126 and the pistons 110, 110'.

FIG. 2A depicts an end sectional view of the radial piston device 100 of FIGS. 1A and 1B, with the housing removed. In this figure, it is clear that the rotor axis $A_R$/pintle axis $A_P$ are aligned but not coaxial with a thrust ring axis (not shown). The plurality of pistons 110 reciprocate radially within the rotor 106 as that element rotates about the central pintle 104. Piston 110 reciprocation occurs due to a radial offset between the thrust ring 126 (more specifically, an inner race 200 thereof) and the rotor 106. As a result, the pistons 110 pump once per revolution of the rotor 106. In that regard, piston 110*e* is located at top dead center (TDC) position and piston 110*a* is located at bottom dead center (BDC) position. The interface between the pistons 110 and the inner race 200 is defined by a spherical piston geometry and a toroidal ring geometry. This promotes rolling of the pistons 110 on the thrust ring 126 in order to prevent sliding. An even number of cylinder sets are used in order to balance the thrust loads acting on the thrust ring 126. In the depicted embodiment, eight cylinder sets are utilized. Special materials or coatings (such as ceramics or nanocoatings) can be used to decrease the friction and increase the longevity of the piston/ring interface.

Figure 2B:
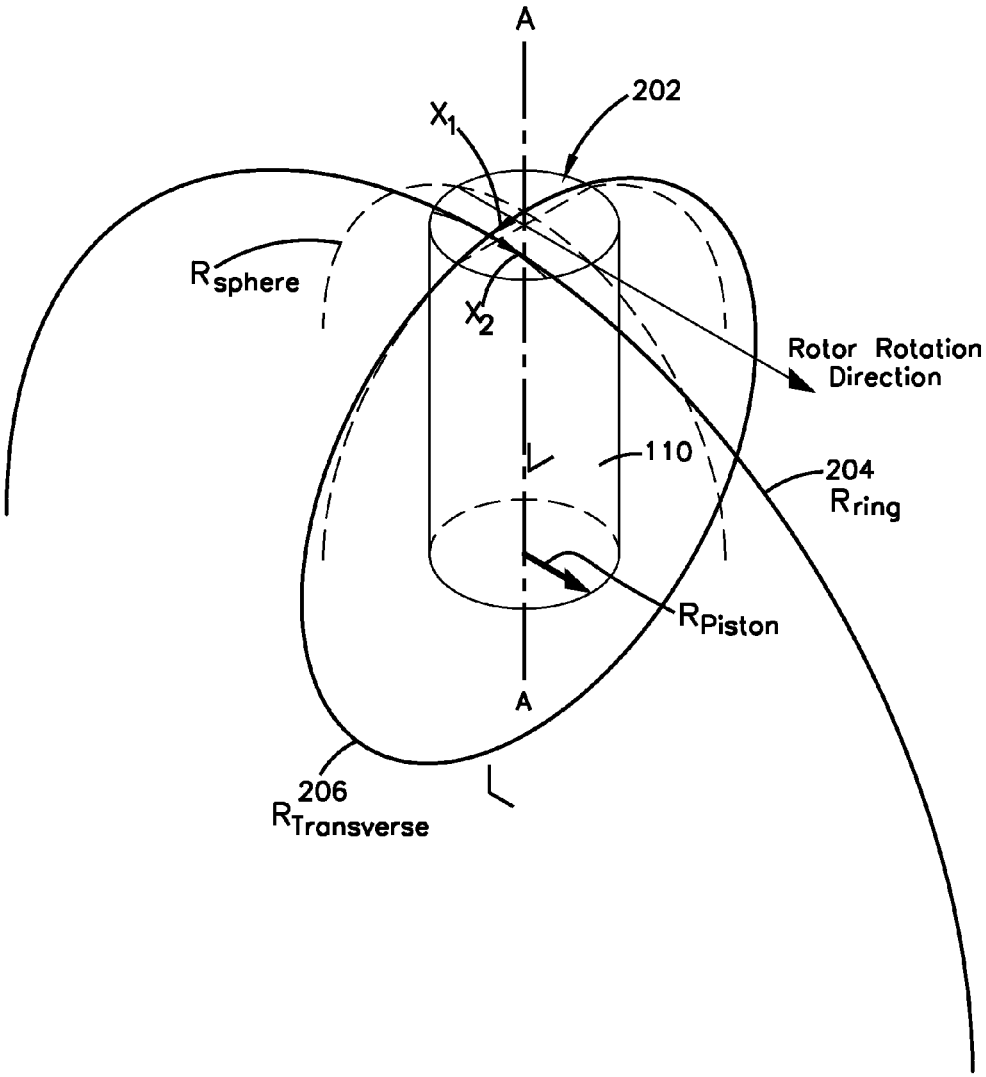
FIGS. 2B-2C are enlarged perspective views of a piston of the radial piston device of FIG. 2A.
Figure 2C:
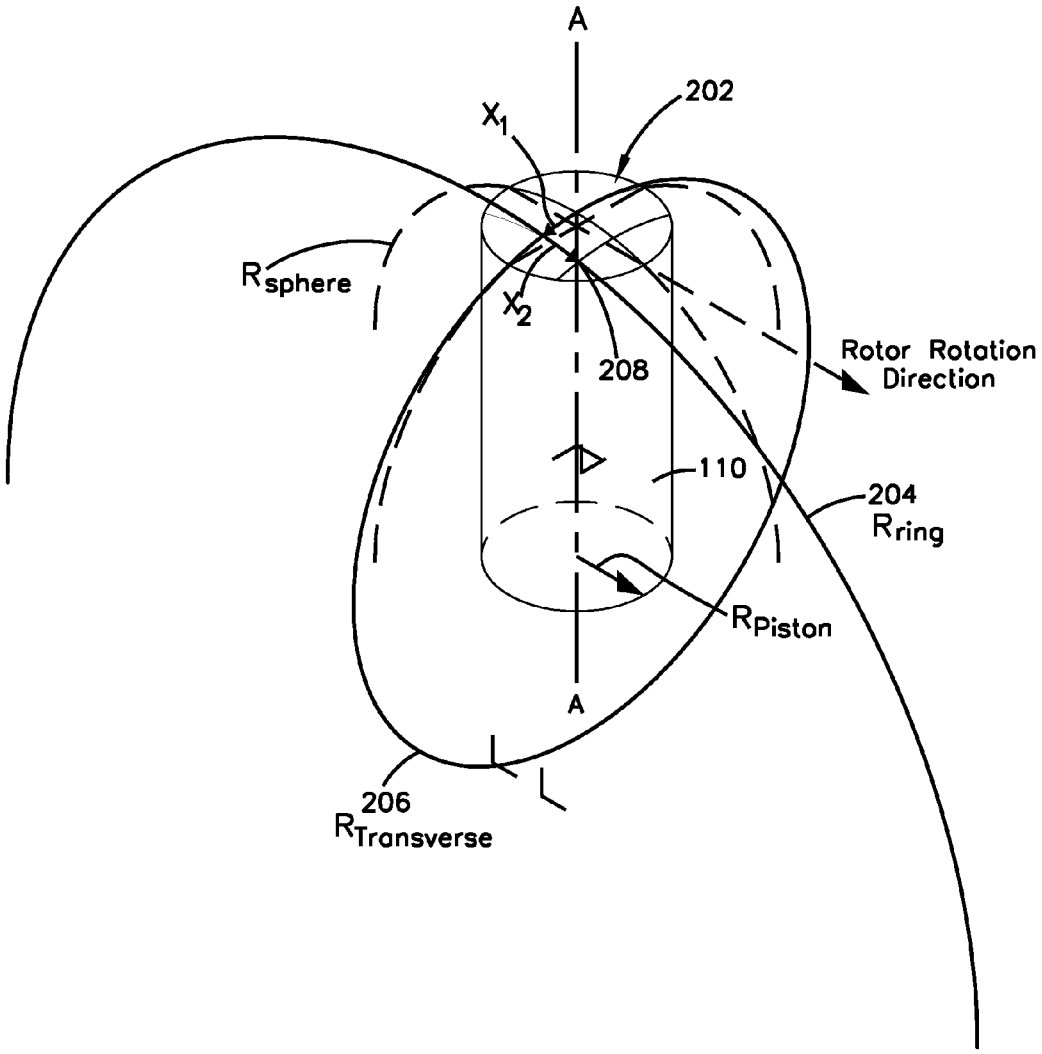
Figure 2D:
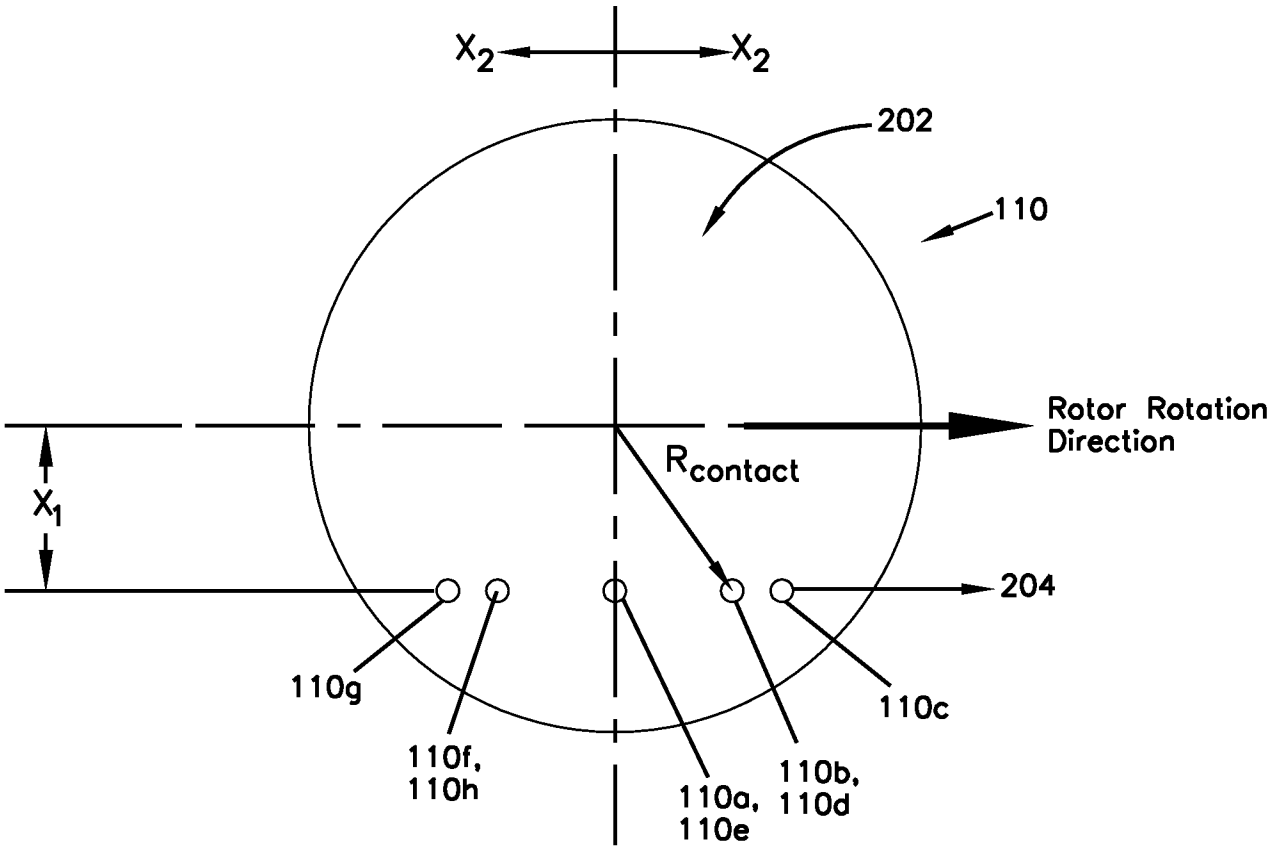
FIG. 2D is an enlarged top view of the piston of FIGS. 2B-2C.

FIGS. 2B and 2C depict a piston 110. The piston geometry includes a spherical piston head 202 in contact with the thrust ring. The contact between the piston 110 and thrust ring occurs offset from the piston axis A. This contact results in rotation of the piston 110 about its own axis A to eliminate sliding friction between the piston 110 and thrust ring for improved efficiency and wear life. As known to a person of skill in the art, the thrust ring is driven at approximately the rotor speed as a result of the piston contact on the thrust ring race. The geometry described herein significantly reduces the contact stress between the piston 110 and the thrust ring, resulting in a significant improvement in the piston life. This is due in part to use of a toroidal surface (circular curvature in orthogonal directions) on the thrust ring race. When constructing the interface geometry, consideration is given to the angle of contact at the dead center positions of the rotor as well as points in between. The contact plane 204 on the thrust ring is determined by establishing the location of the transverse radius relative to the piston axes A. The contact plane 204 is offset from the piston axis as depicted in FIGS. 2B-2D. When the rotor is rotated 90 degrees from the plane of dead centers (i.e., at mid-stroke piston position 110*c*, 110*g*), the contact point 208 on the piston head 202 is offset as illustrated in FIGS. 2B-2D. In FIG. 2A, pistons 110*c* and 110*g* are at the mid-stroke position. When defining the geometry, the contact plane 204 on the thrust ring must be offset from a plane of piston centers 206 to prevent sliding. This offset point 208 should be a radius $r_{contact}$ that is as far a practical from the piston axis A to minimize the piston rotational velocity and to avoid skidding. Further, the geometry should be defined to prevent or at least minimize edge loading of the piston 110 when at the mid-stroke position.

Figure 2F:
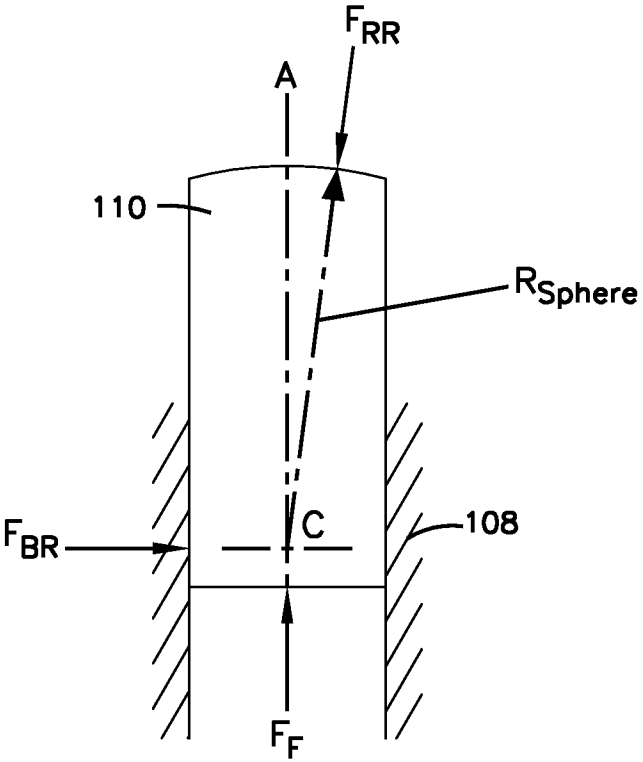
FIGS. 2E-2F are side views of the piston of FIG. 2D.
Figure 2E:
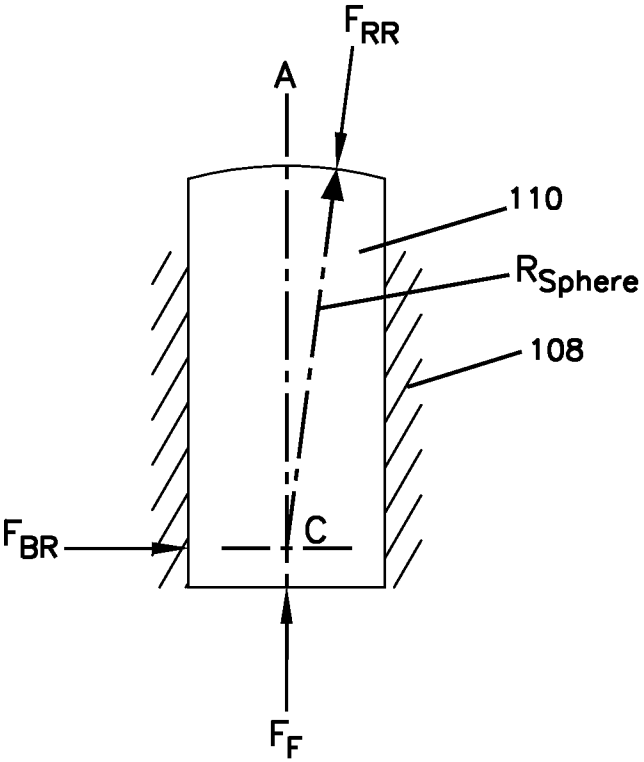

FIG. 2D depicts the contact points between a piston and a thrust ring, in each of the piston locations 110*a*-110*h*, as depicted in FIG. 2A. FIGS. 2E-2F depicts a side view of the piston of FIG. 2D in TDC and BDC positions, respectively. Optimization of piston/ring geometry for the radial piston device depicted herein is described below in the context of FIGS. 2A-2F. In optimizing the piston/thrust ring geometry, a non-exhaustive list of design considerations include:

To avoid piston edge loading, $r_{contact}<d_{piston}/2$.

To minimize contact stress and maximize piston/thrust ring life, $R_{sphere}$ and $R_{transverse}$ should be as close to equal as possible.

To minimize hertzian contact stress and maximize piston/thrust ring life, $R_{sphere}$ and $R_{transverse}$ should be as large as possible.

To promote piston rotation and prevent sliding between the piston and the thrust ring, the contact point (depicted as Points A-H in FIG. 2D) must be offset from the piston axis A at all rotor angles. This offset corresponds to dimension $X_1$ in FIG. 2D.

To minimize mass moment of inertia and fluid churning losses, thrust ring diameter should be as small as possible.

With these considerations in mind, an optimized piston/thrust ring geometry may include a piston head radius of about 0.5" for a radial piston device having a displacement of 0.2 cubic inches/revolution. In a device so sized, an optimized thrust ring race radius may be about 0.55". Piston/thrust ring geometry may by optimized with the use of the following equations:

$$X_1 = R_{sphere} \cdot \frac{x_t}{R_{transverse} - R_{sphere}}$$

Where $X_t$ is the position of the contact point along the contact plane 204. Additionally, the maximum deviation from BDC/TDC thrust ring contact (Points A, E) may be determined by:

$$X_2 = \frac{e \cdot \sin\theta}{\frac{R_{ring}}{R_{sphere} \cdot \frac{\sqrt{(R_{transverse} - R_{sphere})^2 - x_t^2}}{R_{transverse} - R_{sphere}}}} - 1$$

The radius to the contact point from piston axis A at any of Points A-H may be determined by:

$$r_{contact} = \sqrt{X_1^2 + X_2^2}$$

Figure 2H:
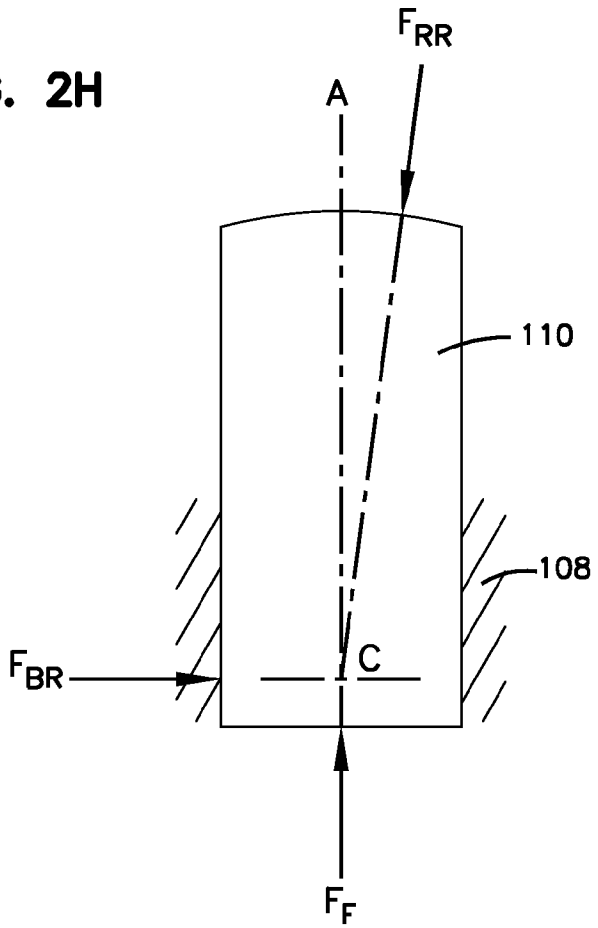
FIGS. 2G-2H are side views of a piston.
Figure 2G:
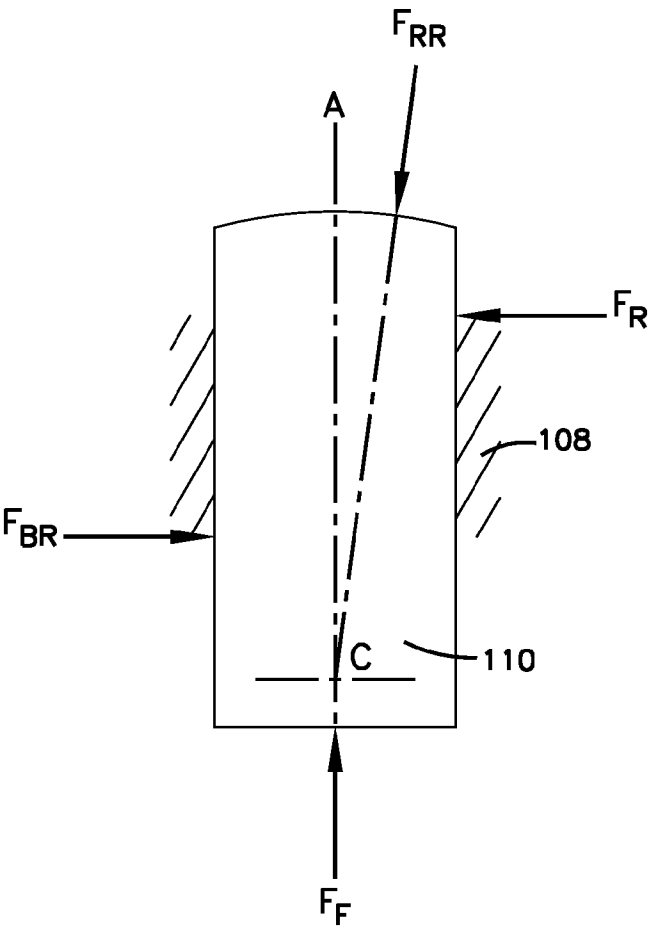

FIGS. 2E-2F depict an enlarged side view of the piston 110 of FIG. 2D. It is desirable that the center point of the piston sphere (that is, the center point C of $R_{sphere}$) remain within the engaged length of the rotor cylinder 108. This geometry results in a minimization of the moment carried by the piston 110 and prevents edge loading on the opposing ends of the cylinder 108. In FIGS. 2E-2F, the horizontal and vertical components of the ring reaction force $F_{RR}$, are offset by the vertical fluid force $F_F$ and the horizontal bore reaction force $F_{BR}$. This has the advantage that the piston side load is reacted through a fluid film along the entire engaged length with the rotor cylinder 108 and any moment applied to the piston 110 due to the horizontal component of the ring reaction force $F_{RR}$ is offset accordingly, allowing piston axis A to remain substantially parallel with a rotor cylinder axis. In contrast, FIGS. 2G-2H depict a condition where the center point C of $R_{Sphere}$ passes outside of the engaged length of the rotor cylinder 108 at certain times during rotation of the rotor. There, the horizontal bore reaction force $F_{BR}$ is insufficient to offset the horizontal component of the ring reaction force $F_{RR}$, thus causing the cylinder 108 to exert a reaction force $F_R$ against the piston 110. This reaction force $F_R$ ultimately causes excessive wear on the piston 110.

Figure 3A:
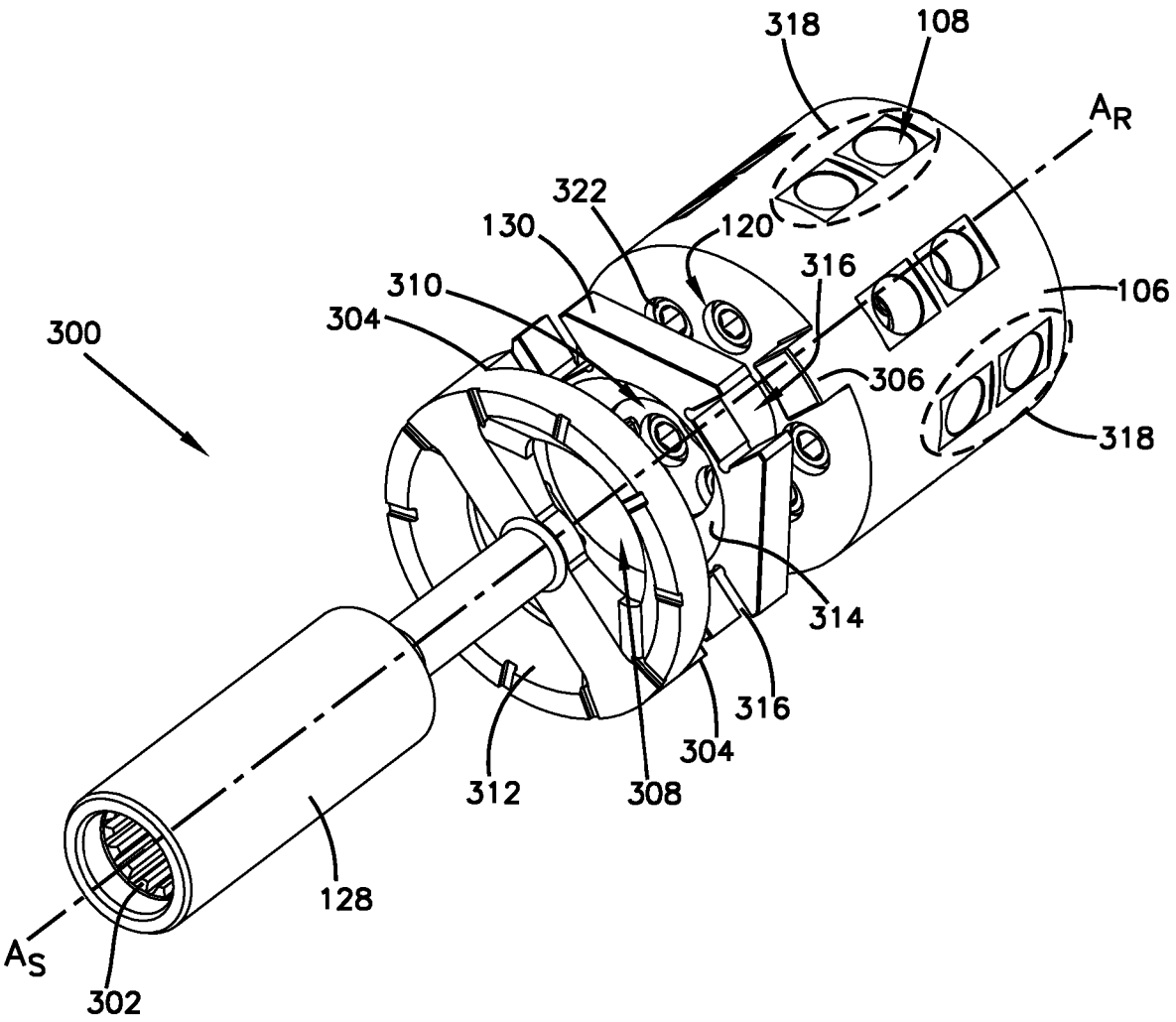
FIGS. 3A-3B are exploded perspective and side views, respectively, of a power transfer assembly of the radial piston device of FIGS. 1A and 1B.
Figure 3B:
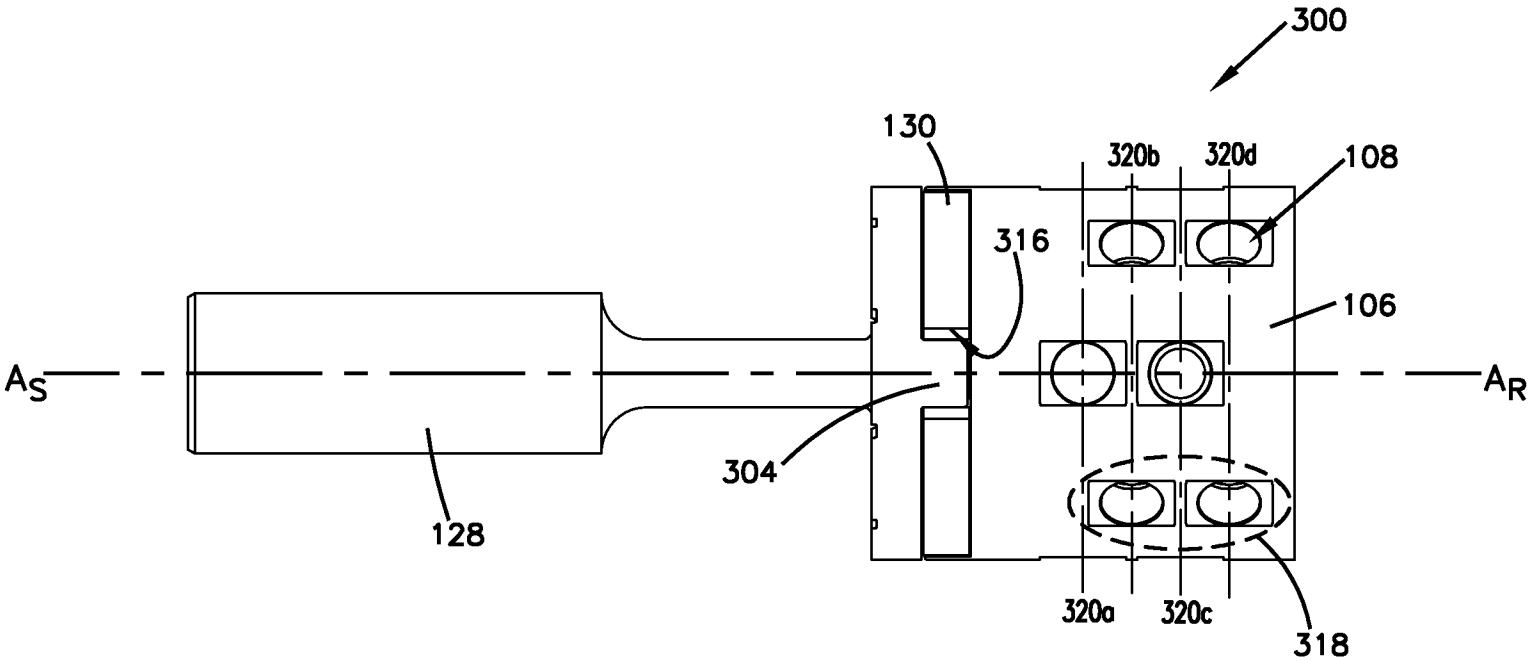

FIGS. 3A and 3B depict a power transfer assembly 300 utilized in the radial piston device. The rotor 106 is engaged with the drive shaft 128, via the flexible coupling 130. The drive shaft 128 includes a number of drive splines 302, in this case, within the drive shaft 128. In other embodiments, the splines may be located on an outer surface of the shaft 128. At an end of the drive shaft 128 opposite the drive splines 302 are a number of shaft teeth 304 to engage the flexible coupling 130. In this case, two shaft teeth 304 engage the flexible coupling 130 at an angle of about 90 degrees from two rotor teeth 306 that also engage the flexible coupling 130. The end of the drive shaft 128 that supports the shaft teeth 304 defines one or more flow passages 308 that allow hydraulic suction flow to pass into the center of the flexible coupling 130. The flexible coupling 130 also defines a flow passage 310 to collect the hydraulic suction flow into the pintle hydraulic fluid inlet 122 (not shown in this figure). Each of the drive shaft flow passages 308 and flexible coupling flow passage 310 may include a tapered or funneled inner surface 312, 314, respectively, that reduces pressure losses as the hydraulic fluid is drawn into the pintle hydraulic fluid inlet 122. The flexible coupling 130 defines a number of receivers 316 for receiving the shaft teeth 304 and the rotor teeth 306. Alternatively, the shaft 128 and rotor 106 may be directly engaged with each other, without the use of the flexible coupling 130. Use of the flexible coupling 130, however, allows for misalignment between the rotor axis $A_R$ and a shaft axis $A_S$. This misalignment prevents radial loading of the drive shaft 128, and allows the rotor 106 to float freely on the pintle journal bearings. In one embodiment, the flexible coupling 130 may be of the type described in U.S. Pat. No. 1,862,220, the disclosure of which is hereby incorporated by reference herein in its entirety.

In the depicted embodiment, each cylinder set 318 is offset from an adjacent cylinder set 318, such that four rows 320 are present on the rotor 106. This helps package the radial piston device in as small of a radial package as possible. A minimum of two rows 320 are necessary to balance the thrust loads on the thrust ring. Of course, other numbers of rows and shafts may be utilized, and additional embodiments and arrangements are described herein. In the depicted embodiment, four piston rows 320*a*-320*d* are utilized. As noted above with regard to FIGS. 1A and 1B, the common fluid inlets 120 are in fluidic communication with both cylinders 108 of each cylinder set 318. This helps reduce the high pressure footprint between the rotor 106 and pintle 104 in order to achieve a more balanced radial load on the pintle journals. In FIG. 3A, the common fluid inlets 120 are blocked with set screws 322. In alternative embodiments, common plugs, Welch plugs, brazed plugs, mechanically locked plug pins (i.e., Lee plugs), cast-in plugs, or weldments may be utilized to block the common fluid inlets 120.

Figure 3C:
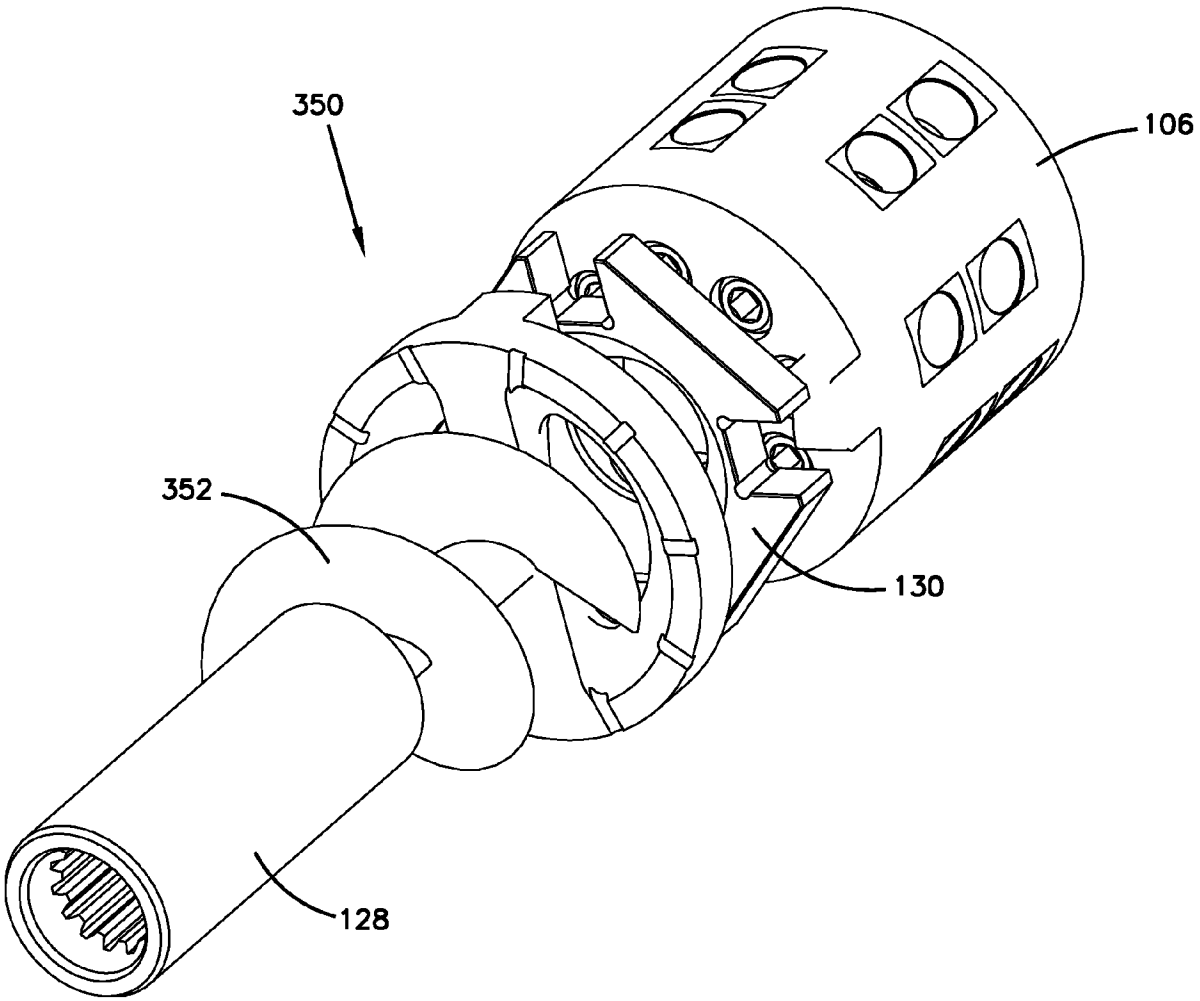
FIG. 3C is an exploded perspective view of a power transfer assembly.

FIG. 3C depicts an alternative embodiment of a power transfer assembly 350. This assembly includes a rotor 106 and a drive shaft 128 coupled by a flexible coupling 130. The drive shaft 128 in this embodiment, however, includes inlet guide vanes 352 that add kinetic energy to the hydraulic fluid passing over the drive shaft 128. These guide vanes 352 may be a pre-swirl, axial, or similarly-configured centrifugal pumping device integrated to the drive shaft 128. Such pumping devices can be used to lower the net positive suction head requirement for the device to near-atmospheric levels, even for very high speed radial piston devices.

Figure 4:
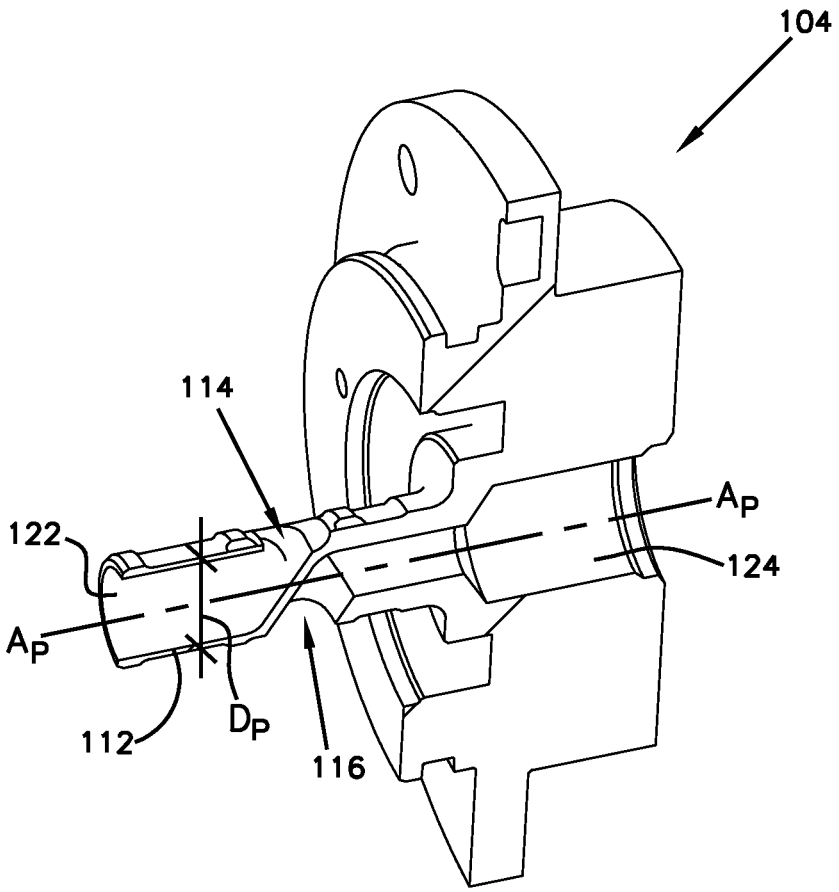
FIG. 4 is a sectional perspective view of a pintle of the radial piston device of FIGS. 1A and 1B.

FIG. 4 is a sectional perspective view of a pintle 104 of the radial piston device of FIGS. 1A and 1B. As depicted, the pintle hydraulic fluid inlet 122 and the pintle hydraulic fluid outlet 124 are substantially aligned with the pintle axis $A_P$ and in fluidic communication with the pintle inlet port 114 and the pintle outlet port 116, respectively. Accordingly, hydraulic fluid flow is directed axially through opposing ends of the pintle 104. In the illustrated configuration, fluid flow is input axially into the pintle hydraulic fluid inlet 122. The hydraulic fluid is then forced radially outward into the rotor cylinders 108, via the pintle inlet port 114. The exit (i.e., outlet) flow from the rotor 106 enters the pintle 104 (radially inward) via the pintle outlet port 116 then proceeds axially through the pintle hydraulic fluid outlet 124 at the opposite end of the radial piston device.

One advantage of this configuration versus known radial porting approaches is the reduced diameter of the pintle 104, specifically the cross-sectional diameter that defines the pintle hydraulic fluid inlet 122 and the pintle hydraulic fluid outlet 124. The cross-sectional flow area through the inlet 122 and outlet 124 is sized to limit the fluid flow velocities based on the pump flow. In the depicted embodiment, the pintle diameter $D_P$ is only slightly larger than an equivalent hydraulic tube diameter in order to support the structural loads on the pintle 104. In pintles depicted in the prior art, in contrast, both inlet and exit flow passages pass through the same pintle cross section. Such a configuration would require at least double the cross sectional area to limit the flow velocities to those possible with the configuration depicted herein. Another advantage of the depicted configuration is the small area under pressure. Only the high pressure portions of the rotor 106 and the pintle 104 are exposed to high pressures. Due to the segregation between the high and low pressures in the radial piston device disclosed herein and the relatively small footprint of high pressure exposure, very high power densities (ratio of power out to pump/motor weight) can be achieved with utilization of lower weight materials (aluminum for instance) for the remaining structural components.

Due to the configuration of the pintle inlet port 114 (as well as the radial orientation of the rotor cylinders 108), the rotor cylinders 108 are able to fill without cavitation on the suction stroke. Radial porting of the fluid into the rotor cylinders 108 offers a distinct advantage over axial porting due to the natural tendency of rotating fluids to accelerate outward. Additionally, the reduced diameter porting allows the torsional drag and volumetric leakage between the rotor 106 and the stationary pintle 104 to be significantly lower than what is attainable with an axial port plate.

Figure 5A:
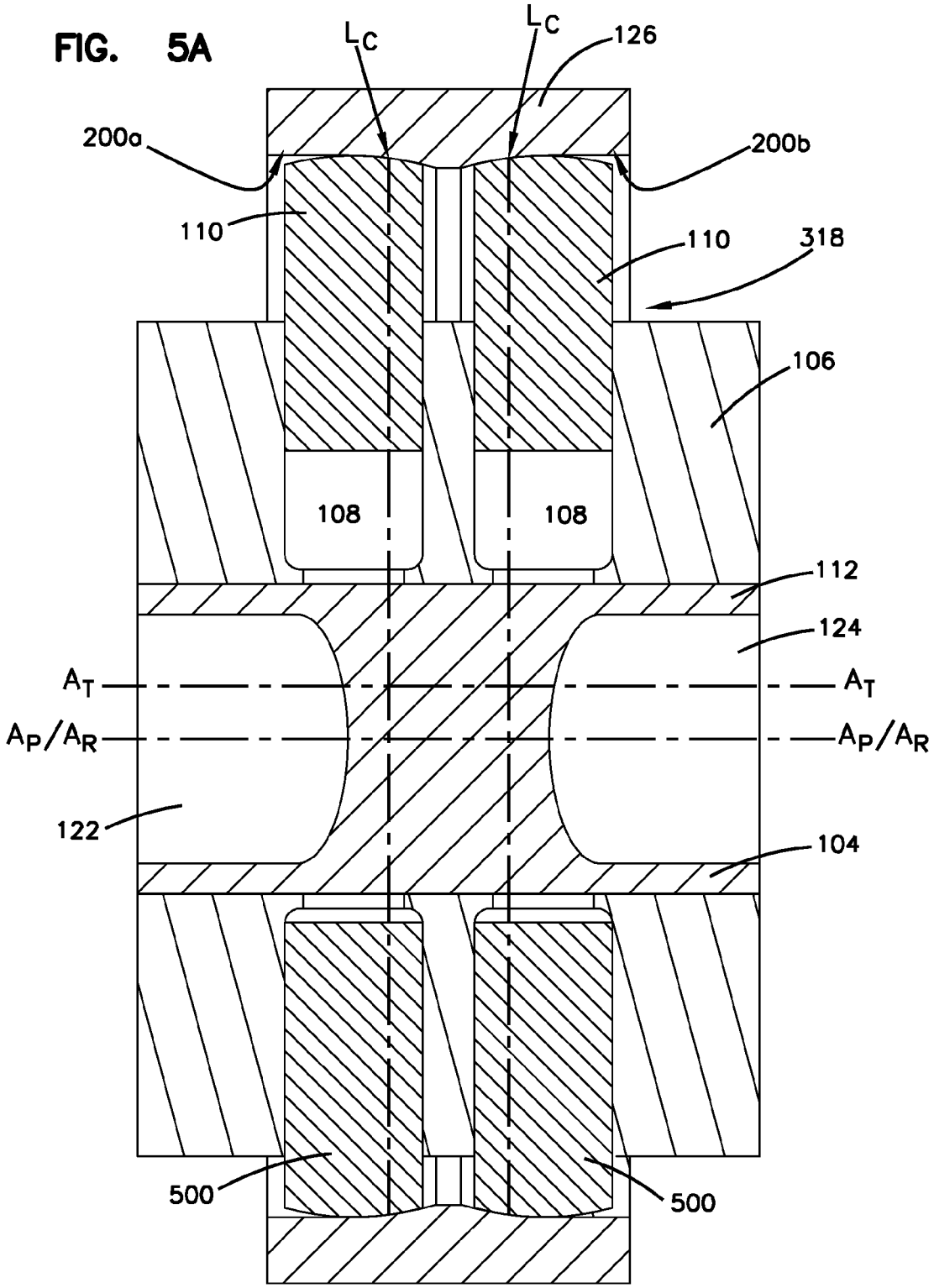
FIGS. 5A-5C are partial enlarged side sectional views of various rotor/thrust ring configurations.
Figure 5B:
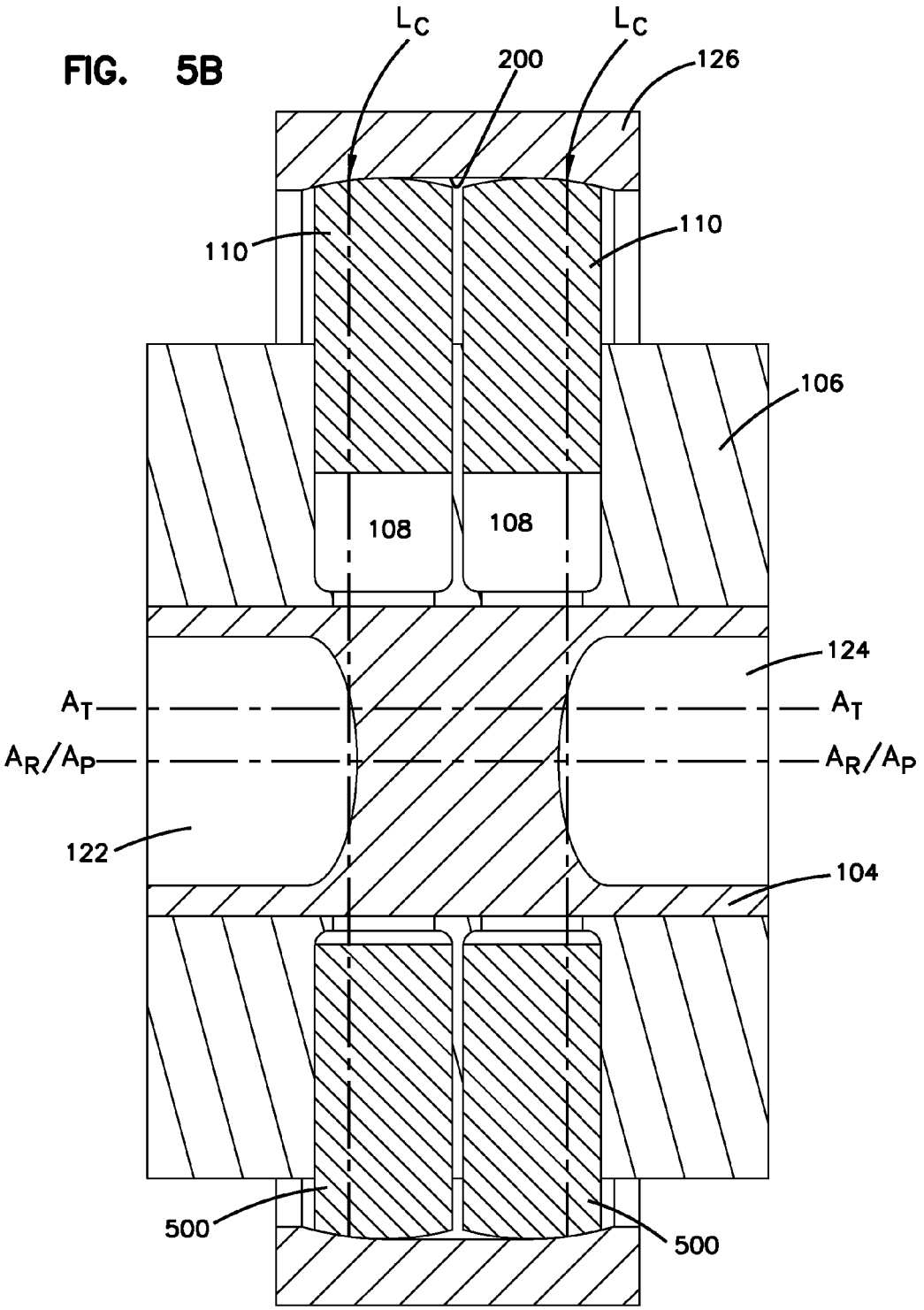
Figure 5C:
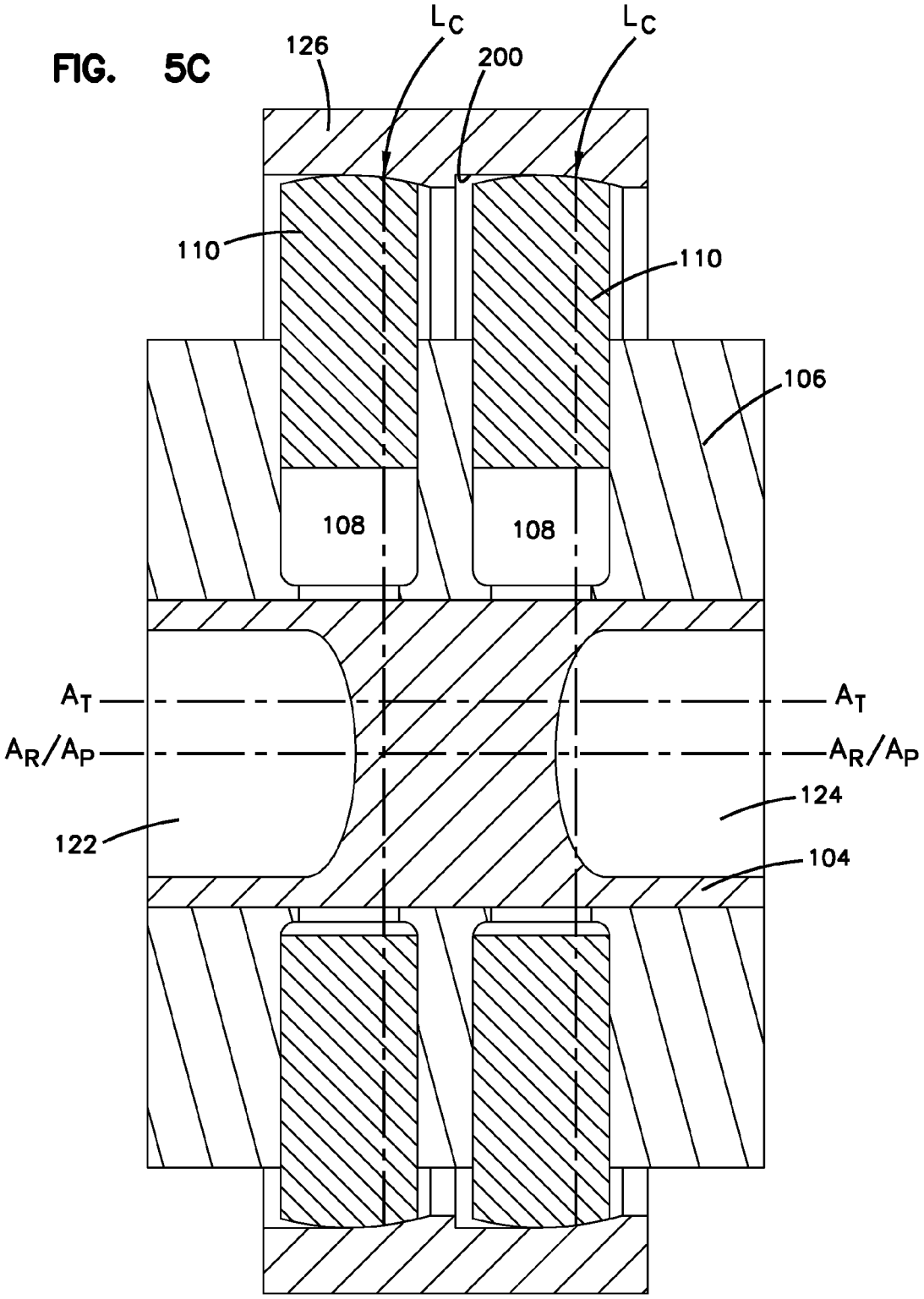

FIGS. 5A-5C are partial enlarged side sectional views of various rotor/thrust ring configurations. In addition to the design considerations described above, another consideration relates to a pump configuration with multiple axial rows of pistons. The piston and ring geometry can be constructed such that opposing sets of pistons are used in order to generate a restoring force which will center the thrust ring along the axis of the pump between the piston rows. This configuration would typically be used in a pump design in which there is little or no sizable axial thrust loads (for instance, if the porting of the pump occurs in the radial direction as in a pintle ported pump design). Different embodiments of this concept are depicted in FIGS. 5A and 5B. In FIG. 5A, the contact points between the pistons 110 and the two inner races 200*a*, 200*b* of the thrust ring 126 are depicted by vertical contact lines $L_C$. FIG. 5B depicts an embodiment having a thrust ring 126 with a single race 200. In either case, the horizontal forces on the rotor 106 generated by contact between the upper 110 and thrust ring 126 are balanced by opposing forces generated by the pistons 500 located diametrically opposite to the upper pistons 110. Also, any thrust load exerted against the rotor 106 by contact between a single piston 110 and the thrust ring 126 is offset by the piston 110 that is axially aligned therewith (that is, the other piston 110 located within a particular piston set 318). FIG. 5C depicts an alternative embodiment that utilizes axial rows of pistons 110 that generate a thrust load on the thrust ring 126 and an opposing thrust load on the rotor 106. Such a configuration also could be used to offset axial bearing loads in certain device configurations where the pump porting is placed on the face of the rotor 106.

While there have been described herein what are to be considered exemplary and preferred embodiments of the present technology, other modifications of the technology will become apparent to those skilled in the art from the teachings herein. The particular methods of manufacture and geometries disclosed herein are exemplary in nature and are not to be considered limiting. It is therefore desired to be secured in the appended claims all such modifications as fall within the spirit and scope of the technology. Accordingly, what is desired to be secured by Letters Patent is the technology as defined and differentiated in the following claims, and all equivalents.

What is claimed is:

1. A radial piston device comprising:

(a) a housing defining a housing hydraulic fluid inlet;

(b) a pintle received within the housing and fixed relative to the housing, wherein the pintle comprises:

a pintle axis;

a pintle wall defining a pintle inlet port and a pintle outlet port;

a pintle hydraulic fluid inlet in fluidic communication with the housing hydraulic fluid inlet and aligned with the pintle axis and in fluidic communication with the pintle inlet port; and a pintle hydraulic fluid outlet aligned with the pintle axis and in fluidic communication with the pintle outlet port;

(c) a rotor rotatably disposed around the pintle, wherein the rotor defines:

a bore, wherein the bore is configured to be rotatably received around the pintle;

a plurality of radially oriented cylinders comprising a first cylinder set comprising a first cylinder and a second cylinder adjacent to the first cylinder and aligned relative to an axis of the rotor;

a first rotor fluid port in fluidic communication with the first cylinder set, wherein when the rotor is in a first position, the first rotor fluid port is in fluidic communication with the pintle inlet port, and wherein when the rotor is in a second position approximately 180 degrees from the first position, the first rotor fluid port is in fluidic communication with the pintle outlet port;

(d) a first piston axially displaceable in the first cylinder and a second piston axially displaceable within the second cylinder, and wherein each of the first piston and the second piston comprises a head defining a spherical contact surface;

(e) a thrust ring rotatably disposed within the housing and about the rotor, wherein the thrust ring is in contact with each of the first piston and the second piston, such that a rotation of the rotor rotates the thrust ring, and wherein an inner surface of the thrust ring defines a toroidal contact surface, and wherein a contact location between the spherical contact surface of the first piston and the toroidal contact surface varies on the spherical contact surface as the rotor rotates from the first position to the second position, wherein the thrust ring is spaced apart from the housing so as to define a hydrodynamic journal bearing; and (f) a drive shaft engaged with the rotor, such that a rotation of the rotor rotates the drive shaft.

2. A radial piston device of claim 1, wherein the draft shaft comprises a plurality of vanes oriented such during a rotation of the drive shaft, the plurality of vanes force a hydraulic fluid into the pintle hydraulic fluid inlet.

3. The radial piston device of claim 1, wherein the first piston comprises a first piston axis extending radially from the pintle axis, and wherein the first piston is rotatable about the first piston axis during axial displacement.

4. The radial piston device of claim 1, wherein the spherical contact surface of the first piston comprises a radius of about 0.5".

5. The radial piston device of claim 1, wherein the toroidal contact surface of the thrust ring comprises a radius of about 0.55".

6. The radial piston device of claim 4, wherein the toroidal contact surface of the thrust ring comprises a radius of about 0.55".

7. The radial piston device of claim 1, wherein the toroidal contact surface of the thrust ring comprises a radius approximately 0.5" larger than the spherical contact surface of the first piston.

8. The radial piston device of claim 1, wherein the toroidal contact surface comprises a first toroidal contact surface and a second toroidal contact surface, and wherein the first toroidal contact surface contacts the first piston head, and wherein the second toroidal contact surface contacts the second piston head.

9. The radial piston device of claim 1, wherein the plurality of radially oriented cylinders further comprises a second cylinder set adjacent to the first cylinder set, and wherein the second cylinder set comprises a third cylinder and a fourth cylinder adjacent to the third cylinder and aligned relative to the axis of the rotor, and wherein the third cylinder and the fourth cylinder are axially offset along the rotor axis relative to the first cylinder and the second cylinder.

10. The radial piston device of claim 1, wherein the plurality of radially oriented cylinders further comprises an opposing cylinder set radially disposed opposite the rotor axis from the first cylinder set.

11. The radial piston device of claim 1, further comprising a flexible coupling for engaging the drive shaft with the rotor.

12. The radial piston device of claim 11, wherein the flexible coupling defines an inlet in fluidic communication with the housing hydraulic fluid inlet and the pintle hydraulic fluid inlet.

13. The radial piston device of claim 1, wherein the thrust ring is axially aligned with and offset from an axis of the rotor.

* * * * *